US006851823B2

(12) United States Patent
Bilotti

(10) Patent No.: US 6,851,823 B2
(45) Date of Patent: Feb. 8, 2005

(54) LIGHTING STRUCTURE FOR PATIO UMBRELLA

(75) Inventor: Alfred J. Bilotti, Huntington Beach, CA (US)

(73) Assignee: Dayva International, Huntington Beach, CA (US)

( * ) Notice: Subject to any disclaimer, the term of this patent is extended or adjusted under 35 U.S.C. 154(b) by 0 days.

(21) Appl. No.: 10/706,004

(22) Filed: Nov. 12, 2003

(65) Prior Publication Data

US 2004/0095749 A1 May 20, 2004

Related U.S. Application Data

(63) Continuation of application No. 10/216,539, filed on Aug. 9, 2002, now Pat. No. 6,659,616.

(51) Int. Cl.[7] ..... A45B 3/02
(52) U.S. Cl. ..... 362/102; 362/363
(58) Field of Search ..... 362/102, 190, 362/191, 431, 363

(56) References Cited

U.S. PATENT DOCUMENTS

| | | | | |
|---|---|---|---|---|
| 3,275,815 | A | 9/1966 | Petroff et al. | |
| 4,425,602 | A | 1/1984 | Lansing | |
| 5,463,535 | A | 10/1995 | Vest | |
| 6,612,713 | B1 * | 9/2003 | Kuelbs | 362/102 |

* cited by examiner

*Primary Examiner*—Sandra O'Shea
*Assistant Examiner*—Hargobind S. Sawhney
(74) *Attorney, Agent, or Firm*—Raymond Sun

(57) ABSTRACT

A lighting structure is removably attached to the pole of a patio umbrella. The lighting structure has a battery housing, a hollow support having a first end attached to the battery housing, a light bulb removably attached to the second end of the hollow support, wiring extending through the hollow support and having a first end positioned in the battery housing and a second end coupled to the light bulb, and a collar for removably attaching the battery housing to the pole.

6 Claims, 3 Drawing Sheets

LIGHTING STRUCTURE FOR PATIO UMBRELLA

RELATED CASES

This is a continuation Ser. No. 10/216,539, entitled "Lighting Structure for Patio Umbrella", filed Aug. 9, 2002 now U.S. Pat. No. 6,659,616, whose disclosure is incorporated by this reference as though fully set forth herein.

BACKGROUND OF THE INVENTION

1. Field of the Invention

The present invention relates to outdoor patio umbrellas, and in particular, to a lighting structure that is adapted to be attached to an outdoor patio umbrella.

2. Description of the Prior Art

Outdoor patio umbrellas have become increasingly popular as more and more people are beginning to conduct more outdoor activities. For example, outdoor dinner parties and events are becoming more common, and patio umbrellas have been useful in providing shade to tables and chairs that have been placed outdoors for these events. Outdoor events that are held in the evenings, when the sun has set, usually need to address the problem of providing sufficient illumination to the location of the event. In this regard, separate lighting systems had to be provided to illuminate the location of the event.

Unfortunately these separate lighting systems can be bulky and difficult to set up. In addition, these conventional lighting systems do not always provide sufficient illumination to the space under a patio umbrella. Another problem associated with illuminating the space under a patio umbrella is that the patio umbrella may be positioned far away from an electrical outlet, thereby requiring the use of wiring to deliver electricity to power any lights associated with the patio umbrella.

Thus, there remains a need to provide improved illumination for outdoor events, and in particular, to the space under a patio umbrella.

SUMMARY OF THE INVENTION

It is an objective of the present invention to provide illumination to the space under a patio umbrella.

It is another objective of the present invention to provide a lighting device that can be conveniently deployed at any location along the pole of a patio umbrella.

To accomplish the above objectives, the present invention provides a lighting structure that is removably attached to the pole of a patio umbrella. The lighting structure has a battery housing, a hollow support having a first end attached to the battery housing, a light bulb removably attached to the second end of the hollow support, wiring extending through the hollow support and having a first end positioned in the battery housing and a second end coupled to the light bulb, and a collar for removably attaching the battery housing to the pole.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

As used herein, the terms "lighting device 10" and "lighting structure 10" shall mean the same element.

Figure 1:
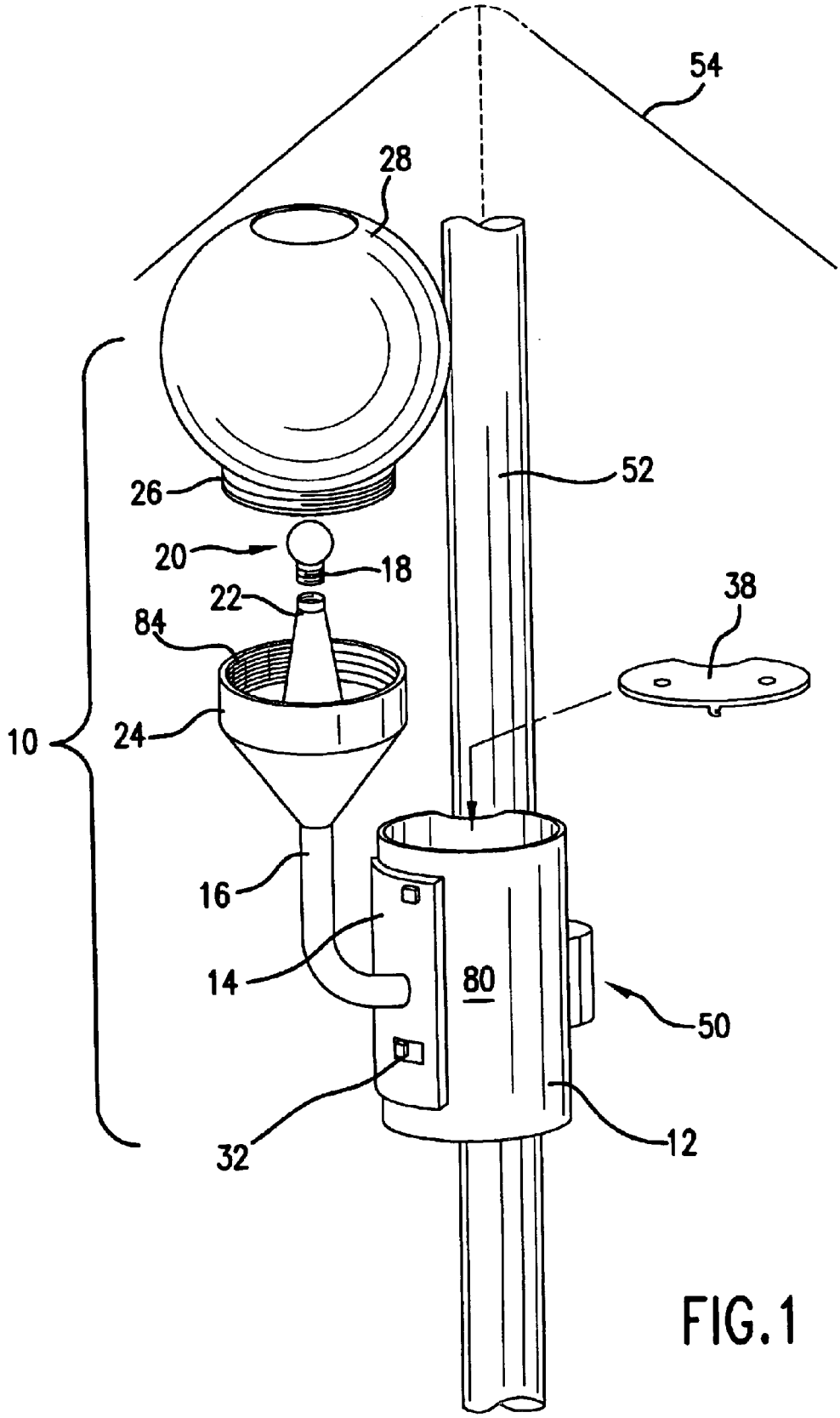
FIG. 1 is a perspective view of a lighting device according to one embodiment of the present invention shown in use with a pole of a patio umbrella.
Figure 2:
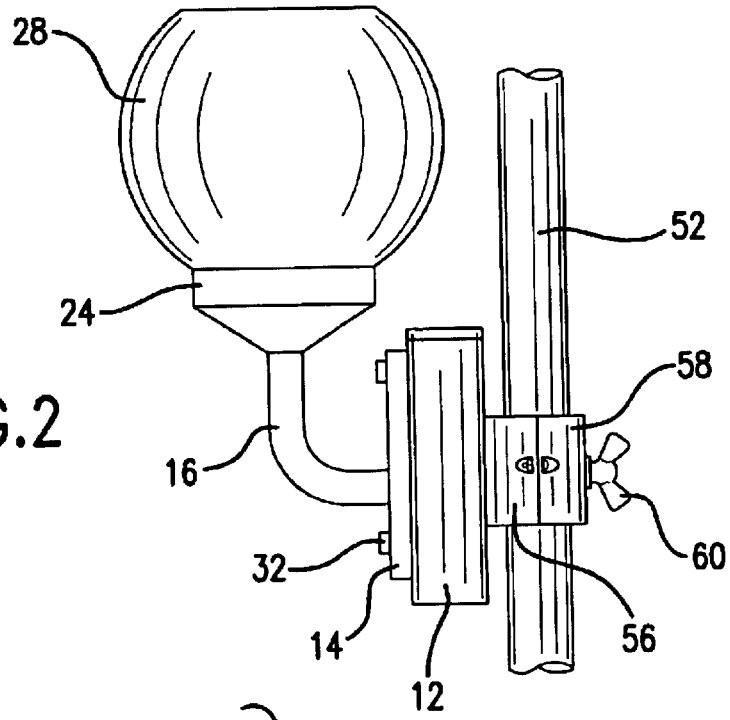
FIG. 2 is a side plan view of the lighting device of FIG. 1 shown in use with a pole of a patio umbrella.
Figure 3:
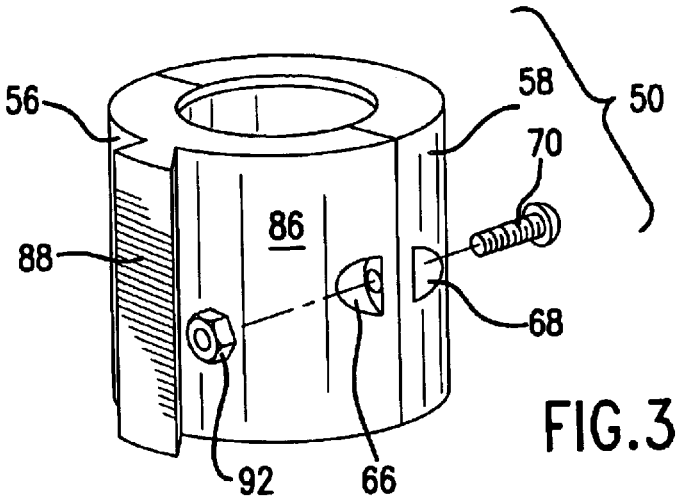
FIG. 3 is a perspective view of the collar that is used to connect the lighting device of FIG. 1 to the pole of a patio umbrella.
Figure 4:
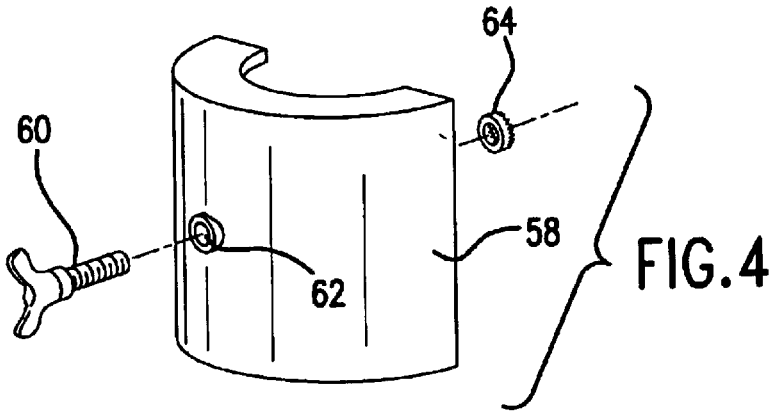
FIG. 4 is an exploded perspective view of the outer piece of the collar of FIG. 3.
Figure 5:
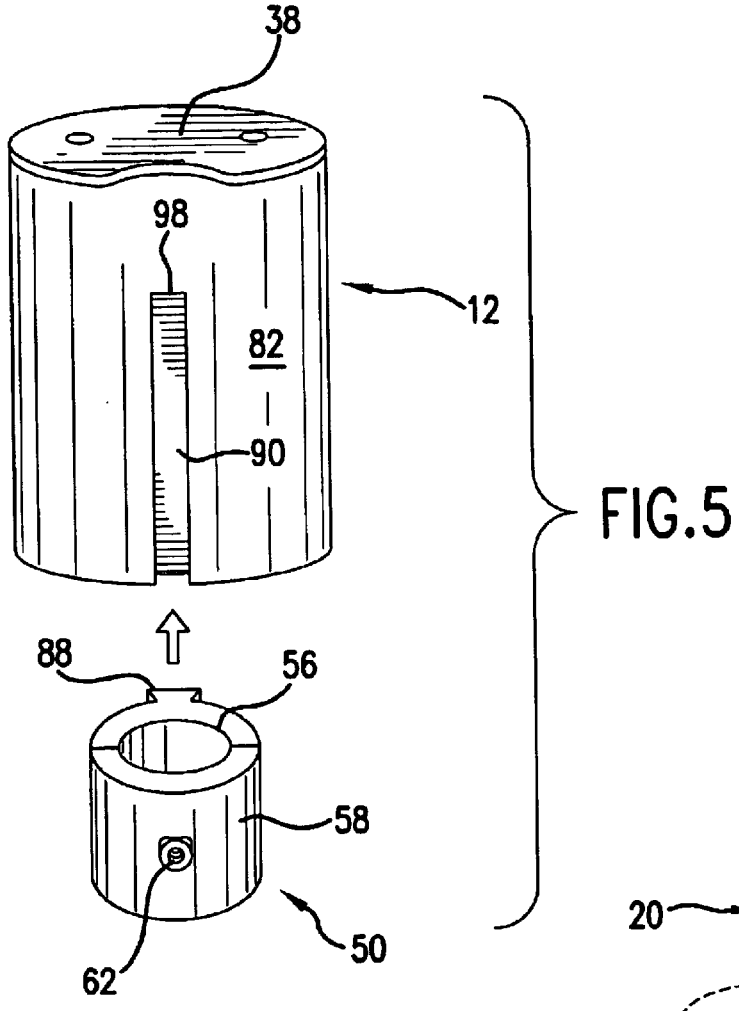
FIG. 5 is an exploded view illustrating how the collar of FIG. 3 couples the battery housing of the lighting device of FIG. 1.

FIGS. 1 and 2 illustrate a lighting device 10 according to one embodiment of the present invention. The lighting device 10 has a battery housing 12 that is adapted to hold one or more batteries (not shown) that are used to power the lighting device 10. The battery housing 12 has a curved configuration with a convex outer surface 80 and a concave outer surface 82 (see FIG. 5). A plate 14 is secured to the convex outer surface 80 of the battery housing 12, and a hollow L-shaped support 16 has a bottom end that is attached to the plate 14. The top end 22 of the support 16 has internal connection threads that are adapted to threadably engage the external threads 18 on a conventional light bulb 20 (see also FIG. 4). A funnel-shaped bulb holder 24 is attached to a selected location along the length of the support 16 that is spaced apart from the top end 22. The bulb holder 24 has internal threads 84 that are adapted to threadably engage the external threads 26 on the neck of a globe 28. The globe 28 is generally translucent to allow the light emitted from the light bulb 20 to pass therethrough, and also functions to disperse the light.

Figure 7:
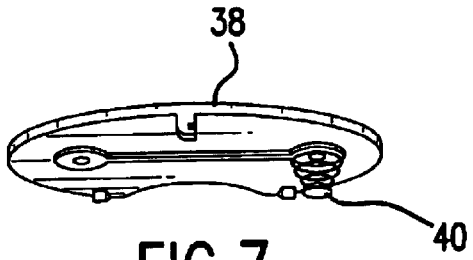
FIG. 7 is a bottom perspective view of a battery cover of the lighting device of FIG. 1.
Figure 6:
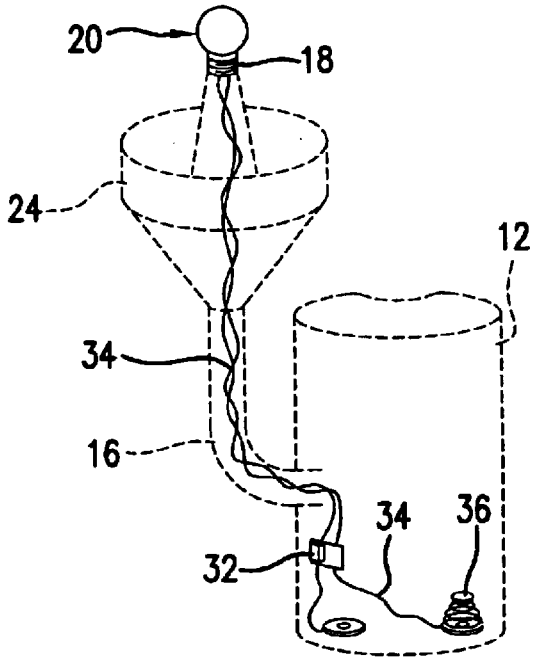
FIG. 6 illustrates the electronics of the lighting device of FIG. 1.

An on/off switch 32 extends through an opening in the plate 14. Referring to FIG. 6, wiring 34 connects a contact 36 in the battery housing 12 with the switch 32, and extends through the hollow interior of the support 16 to the top end 22 where it is electrically coupled to the light bulb 20. Referring to FIG. 7, a battery cover 38 is provided to fit over the open top of the battery housing 12. The battery cover 38 has a contact 40.

Referring now to FIGS. 2–5, a two-piece collar 50 functions to removably connect the battery housing 12 to any location along the pole 52 of a patio umbrella 54. The two-piece collar 50 has an inner piece 56 and an outer piece 58. The inner piece 56 can have a generally semi-circular configuration, and has an outer surface 86 that includes a generally V-shaped extension 88 that extends from the top to the bottom of the outer surface 86. The V-shaped extension 88 is adapted to be removably received inside a corresponding V-shaped slide groove 90 provided along the concave outer surface 82 of the battery housing 12. The outer piece 58 can also have a generally semi-circular configuration, and can be removably attached to the inner piece 56 in a manner such that the two pieces 56 and 58 form a circular unit when they are attached together. Specifically, a threaded opening 62 can be provided in the wall of the outer piece 58, and a threaded bolt 60 can be threaded through the opening 62 and secured by a nut 64 that is positioned inside the outer piece 58. The bolt 60 can be adjusted to allow the collar 50 to be used with poles 52 of different lengths, and to further secure the collar 50 against the pole 52. In addition, each of inner and outer pieces 56 and 58 has a recessed region 66 and 68, respectively, with a threaded bore extending through each recessed region 66 and 68. Another threaded bolt 70 is threaded through each of the threaded bores in the recessed regions 66 and 68 to removably couple the inner and outer pieces 56 and 58 around any selected location along the length of the pole 52. A nut 92 can be used to tighten the threaded bolt 70.

In use, the user positions the inner piece 56 at a selected location along the pole 52, and then aligns the outer piece 58 to the inner piece 56 at the selected location so that the two pieces 56, 58 form a circular unit. The user then attaches the outer piece 58 to the inner piece 56 by threading the bolt 70 through the bores of the recesses 66 and 68, and tightening the nut 92 to tightly secure the entire collar 50 to the selected location along the pole 52. Next, the battery housing 12 can be secured to the inner piece 56 by sliding the sliding groove 90 along the concave outer surface 82 of the battery housing 12 over the extension 88 of the collar 50. The sliding groove 90 has a stop edge 98 that abuts the top of the extension 88 to prevent the battery housing 12 from sliding off the extension 88. At this time, the switch 32 can be turned on or off to turn on or off the light bulb 20.

When the patio umbrella 54 is to be folded for storage, the user can remove the lighting structure 10 by first lifting the battery housing 12 upwardly to slide the battery housing 12 off the extension 88. The user can then remove the inner and outer pieces 56 and 58 by unthreading the bolt 70. The various components (i.e., the globe 28, the support 16 and battery housing 12, the inner piece 56, and the outer piece 58) can then be separated for storage, or stored together as one unit.

Thus, the present invention provides a lighting structure 10 that can be conveniently attached to and removed from the pole 52 of a patio umbrella 54. The construction of the lighting structure 10 is simple. Since the light structure 10 provides a light bulb 20 whose light can be widely dispersed by the globe 28, positioning the lighting structure 10 under the patio umbrella 54 will provide bright illumination to the space under the patio umbrella 54. The location of the lighting structure 10 along the pole 52 can be conveniently adjusted to change the illumination. In addition, the bulb 20 can be a two-way bulb that provides different degrees of illumination, and the switch 32 can be equipped to allow the user to switch between the different degrees of illumination. The provision of the battery housing 12 also means that the lighting device 10 can be powered by batteries, so that unsightly and cumbersome wires can be avoided.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An assembly, comprising:

a patio umbrella having a pole; and a lighting structure having:

a battery housing that is removably attached to the pole;

a support having a first end attached to the battery housing, and a second end;

a light bulb removably attached to the second end of the support; and wiring extending through the support and having a first end coupled to the battery housing and a second end coupled to the light bulb.

2. The assembly of claim 1, further including a switch coupled to the wiring.

3. The assembly of claim 1, wherein the lighting structure further includes a bulb holder attached to the hollow support, and a globe removably attached to the bulb holder and covering the light bulb.

4. The assembly of claim 1, further including a first piece and a second piece that are removably attached to each other about the pole, with the first piece removably attached to the battery housing.

5. The assembly of claim 4, wherein each of the first and second pieces has a semi-circular configuration.

6. The assembly of claim 4, wherein the battery housing has a groove, and the first piece has an extension that is removably received in the groove.

* * * * *